US006112887A

United States Patent [19]

Harrison

[11] Patent Number: 6,112,887

[45] Date of Patent: Sep. 5, 2000

[54] DISPOSABLE LIGHTER HOLDER

[75] Inventor: Kerry Max Harrison, Apartment T1,3rd Floor, Block D, Victoria Palace, 13 Blvd. Princesse Charlotte MC98000, Monaco

[73] Assignee: Kerry Max Harrison, Monte Carlo, Monaco

[21] Appl. No.: 09/369,475

[22] Filed: Aug. 6, 1999

[30] Foreign Application Priority Data

Aug. 6, 1998 [AU] Australia ..... PP5088
Jun. 3, 1999 [AU] Australia ..... PQ0747

[51] Int. Cl.[7] ..... A24F 15/00

[52] U.S. Cl. ..... 206/87; 206/457; 431/253

[58] Field of Search ..... 206/86, 87, 457, 206/594; 431/126, 253; D27/148, 149

[56] References Cited

U.S. PATENT DOCUMENTS

D. 360,483 7/1995 Milazzo ..... D27/148
4,212,386 7/1980 Maisonneauve ..... 206/457
4,522,583 6/1985 Kraser ..... 431/125
4,753,346 6/1988 Tsuji ..... 206/457
5,067,895 11/1991 Chuang et al. ..... 431/253
5,454,657 10/1995 Kim ..... 431/253

*Primary Examiner*—David T. Fidei
*Attorney, Agent, or Firm*—Baker & McKenzie

[57] ABSTRACT

A disposable lighter holder including a first body member having an aperture, a plurality of lugs connected to the first body member, a first recess located between the plurality of lugs, and an abutment located at an end of the first recess. The disposable lighter holder further includes a second body member being opposite and connected to the first body member and a second recess formed in the second body member. The second recess includes a concave surface and a plurality of tapering sides. The aperture, first recess, plurality of lugs, concave surface and plurality of tapering sides of the second recess frictionally engage a lighter inserted through the aperture of the first body member.

15 Claims, 3 Drawing Sheets

FIG. 6
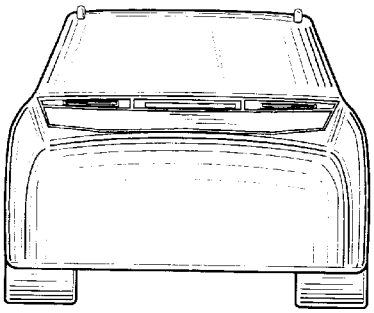
FIG. 7
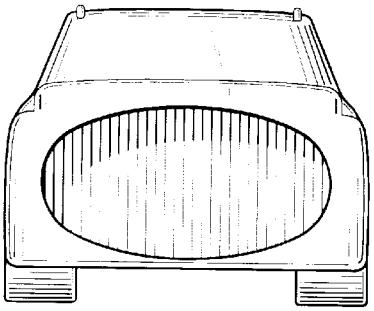
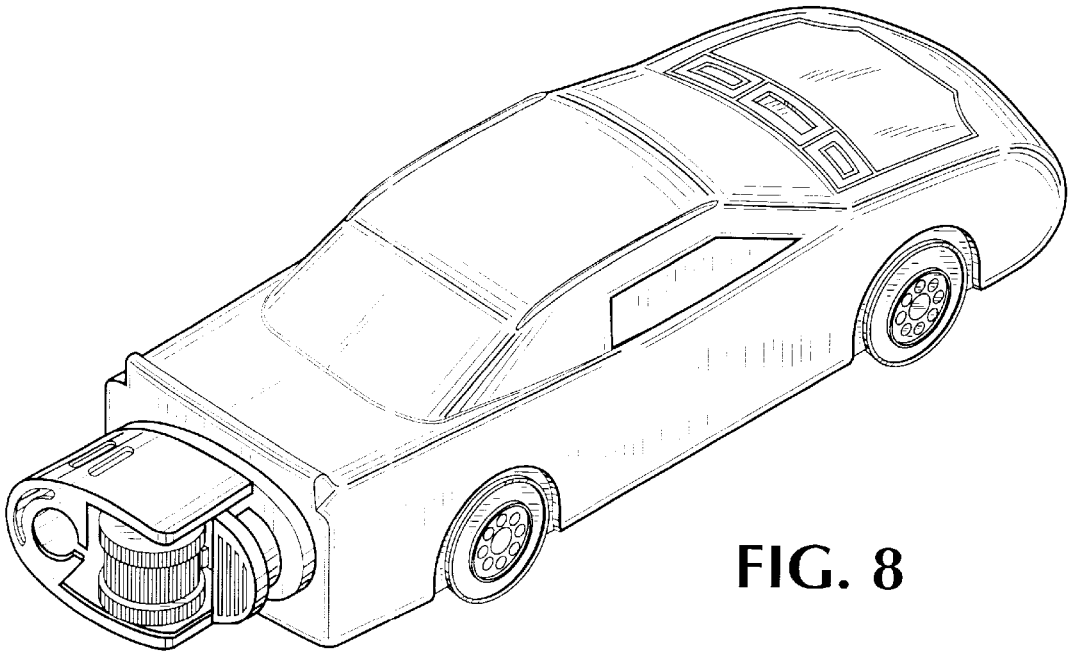
FIG. 8

DISPOSABLE LIGHTER HOLDER

FIELD OF THE INVENTION

The present invention relates to a disposable lighter holder, in particular to a scale model vehicle cigarette lighter holder.

BACKGROUND INFORMATION

Disposable cigarette lighters are well known and are constructed to be disposed of when the fuel is exhausted. One example of such a disposable cigarette lighter is shown in U.S. Pat. No. 5,483,978. Such lighters are generally carried in a pocket or in a purse. Due to the shape and size of the lighter, however, they may be easily lost or not easily retrieved from ones pocket or purse. Accordingly, a need exists for an easily identifiable disposable lighter holder that reduces the chance of the lighter being lost and provides easy retrieval of the lighter from ones pocket or purse. Further, a need exists for a lighter holder that allows the disposable lighter to be easily removed and securely held in place.

SUMMARY OF THE INVENTION

An aspect of the present invention provides a lighter holder that includes a first body member having an aperture, a plurality of lugs connected to the first body member and a first recess located between the plurality of lugs. The lighter holder also includes an abutment located at an end of the first recess. The aperture, first recess and plurality of lugs frictionally engage a lighter inserted through the aperture of the first body member.

Another aspect of the present invention provides a disposable lighter holder including a first body member having an aperture, a plurality of lugs connected to the first body member, a first recess located between the plurality of lugs and an abutment located at an end of the first recess. The disposable lighter holder further includes a second body member being opposite and connected to the first body member and a second recess formed in the second body member. The second recess includes a concave surface and a plurality of tapering sides. The aperture, first recess, plurality of lugs, concave surface and the plurality of tapering sides of the second recess frictionally engage a lighter inserted through the aperture of the first body member.

BRIEF DESCRIPTION OF THE DRAWINGS

FIG. 6 is a plan view of two members of the lighter holder of FIG. 5.

FIG. 7 is a side elevation of the lighter holder of FIG. 5 holding a disposable cigarette lighter.

DETAILED DESCRIPTION

Figure 1:
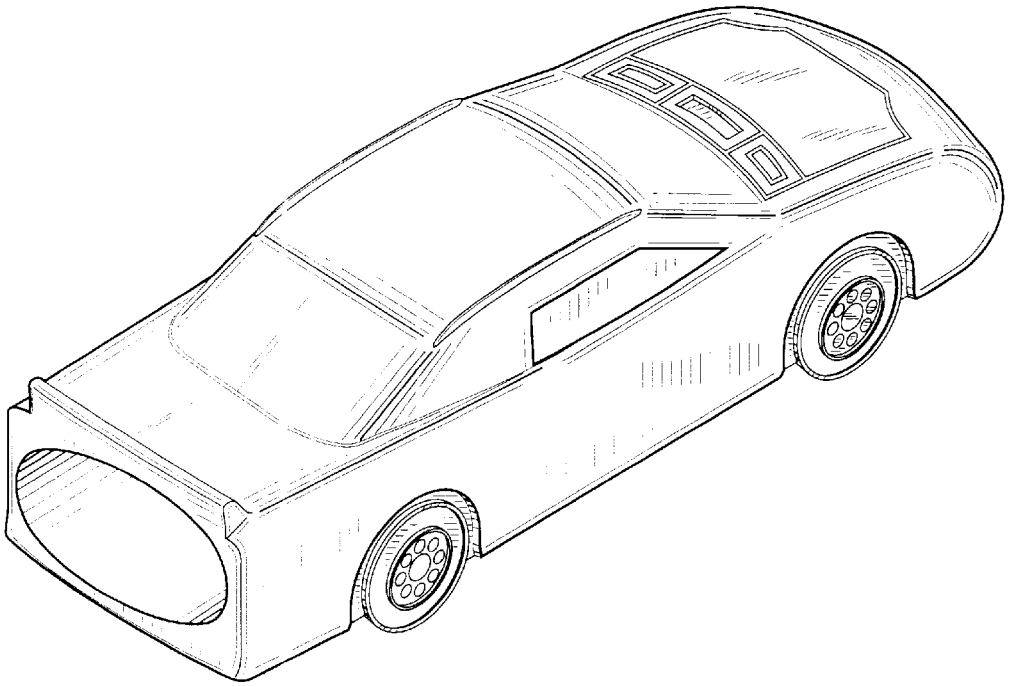
FIG. 1 is a perspective view of an exemplary embodiment of a disposable lighter in the form of a scale model motor vehicle.

An exemplary embodiment of a scale model vehicle disposable lighter 10 of the present invention is shown in Figs. 1. and 2. The scale model vehicle disposable lighter 10 includes a scale model vehicle body portion 12 and a cigarette lighter portion 14. The body portion 12 may be formed in a variety of shapes such as a scale model of a NASCAR vehicle, a VW Beetle, a London (double-decker) bus, a VW Kombi van, an FJ Holden, or of any other vehicle or article. The body portion 12 of the scale model vehicle disposable lighter 10 may include similar livery including names, brands, logos and the like as the full-scale vehicle of which the scale model vehicle disposable lighter 10 is a scale model.

Figure 3:
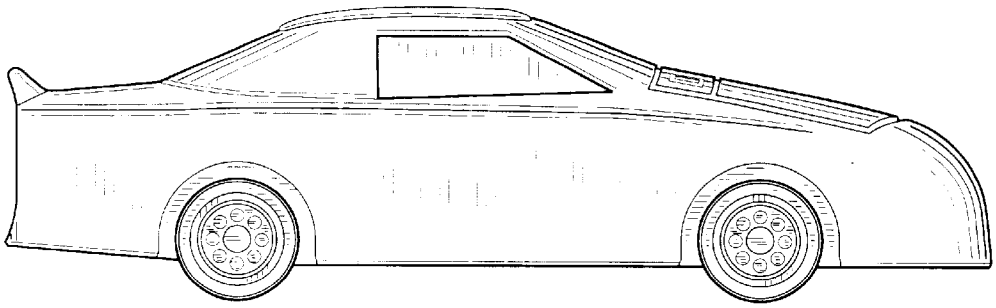
FIG. 3 is a perspective view from above and to the rear of the scale model vehicle body portion of the disposable lighter of FIG. 1.

FIG. 3 shows the body portion 12 of the scale model vehicle disposable lighter 10 having a hollow interior area 16 and an opening 18 accessing the hollow interior area 16. In an exemplary embodiment of the present invention, the opening 18 is located at the rear end of the body portion 12. The hollow interior area 16 receives a conventional disposable lighter 14 such as that shown in FIG. 4.

In an exemplary embodiment of the present invention, the scale model vehicle disposable lighter 10 may include a molded scale model body portion 12 in place of the conventional flattened-oval shaped fuel-containing portion 20 of the conventional lighter 14. A body portion 12 may be attached to the conventional lighter 14 by clipping the body portion 12 laterally to the convention lighter 14 or the use of an adhesive.

In an exemplary embodiment of the present invention, the body portion 12 may include a hollow interior area 16, for example, as shown in FIG. 3. Accordingly, a conventional lighter 14 such as a disposable cigarette lighter shown in FIG. 4 may be inserted for permanent attachment to the body portion 12. Thus, a scale model vehicle disposable lighter 10 may be produced in an economical and timely manner by using a conventional lighter 14. In an exemplary embodiment of the present invention, the scale model vehicle disposable lighter 10 may be disposable. For example, the conventional lighter 14 may be permanently attached to the body portion 12, for example, by force-fitting, an adhesive, or any suitable manner. In another embodiment of the present invention, the conventional lighter 14 may be held in the scale model vehicle disposable lighter holder 100 in a removable and replaceable manner as shown in FIG. 7.

Figure 4:
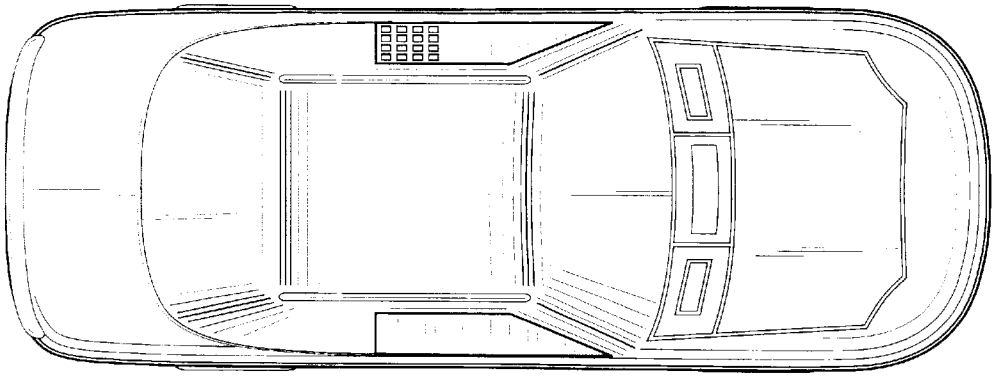
FIG. 4 is a side elevation of a conventional disposable lighter.

As shown in FIG. 4, the conventional lighter 14 includes a wind guard 22, a dual-wheel flint actuator 24 to produce a spark, and a lever 26 for allowing fuel to pass to the ignition area within the wind guard 22. Conventional disposable lighters 14 as shown in FIG. 4 may include a shoulder 28 or the like between the fuel reservoir 20 and the flame-producing part of the lighter 14. In an exemplary embodiment of the present invention, the shoulder 28 may be used to permanently secure the lighter 14 within the hollow interior area 16 of the body portion 12. In an exemplary embodiment of the present invention, one or more shoulder lugs (not shown) would deform to allow the shoulder 28 to pass into the hollow interior area 16 of the body portion 12 when the conventional lighter is placed therein. In an exemplary embodiment of the present invention the shoulder lugs may be one-way lugs. One-way lugs would prevent the shoulder 28 from passing the lugs when an attempt is made to withdraw the conventional lighter 14. Additionally, an amount of suitable adhesive may be placed in the hollow interior area 16 of the scale model vehicle disposable lighter 10 prior to the placement of the conventional lighter 14 therein. The adhesive may be placed in a rear portion of the hollow interior area 16 of the body portion 12.

Figure 2:
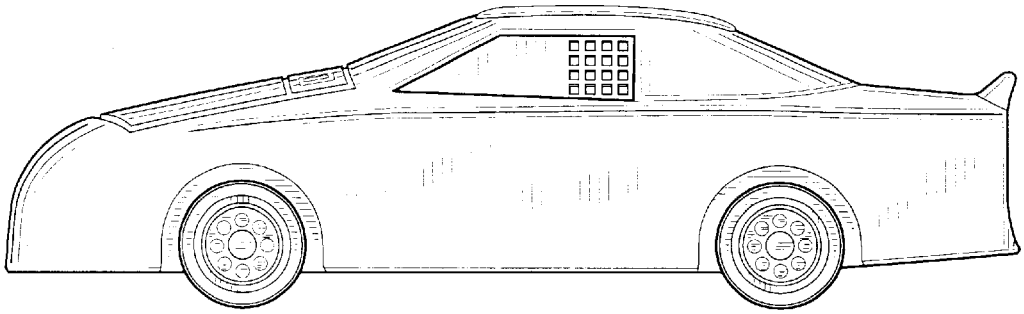
FIG. 2 is a side elevation of the disposable lighter of FIG. 1.

The body portion 12 may be molded from plastic such as a flame-retardant plastic. Accordingly, the weight of the scale model vehicle disposable lighter 10 and the amount of damage to the scale model vehicle disposable lighter 10 due to the flame would be reduced. Alternatively, the body portion 12 may be die cast from metal or any other suitable material. As shown in FIGS. 1 and 2, the conventional lighter 14 may be inserted into the body portion 12 leaving the head part of the lighter portion 14, that is, the shoulder 28 to the wind guard 22, extending beyond the body portion 12 of the scale model vehicle disposable lighter 10. Accordingly, the conventional lighter 14 may be operated in a conventional manner with the scale model vehicle disposable lighter 10 gripped in user's hand and the user's thumb operating the actuator 24 of the conventional lighter 14.

The scale model vehicle disposable lighter 10 may include a cover (not shown). The cover may be attached to the body portion 12 and hide the working parts of the conventional lighter 14. The cover may be, for example, a hinged, hollow cover which could be rotated to allow the conventional lighter 14 to be lit, and then returned to its initial position after the conventional lighter 14 has been used. In an exemplary embodiment of the present invention, the range of rotation of the cover may be equal or less than 180 degrees. The hollow cover may be constructed to form part of the body portion 12 of the scale model vehicle disposable lighter 10.

Figure 5:
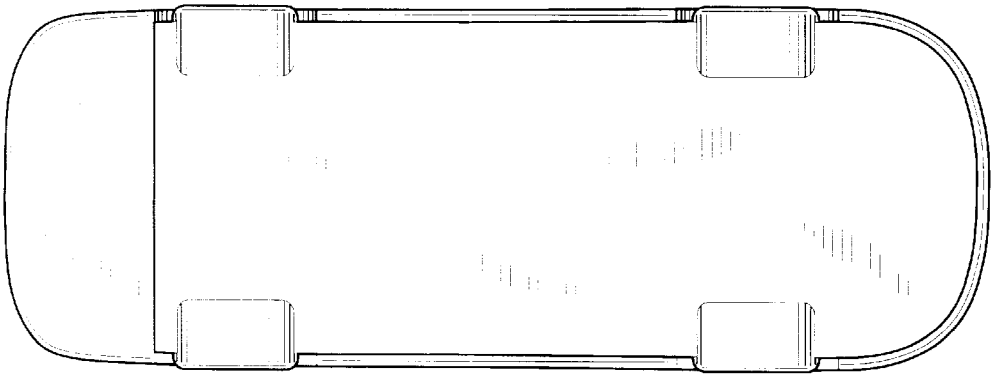
FIG. 5 is a perspective view of an exemplary embodiment of a scale model vehicle cigarette lighter holder for holding a disposable lighter.

In an exemplary embodiment of the present invention, a disposable lighter holder 100, for example, as shown in FIGS. 5 and 6 may be formed from two body portions 102, 104. The body portions 102, 104 may be formed from plastic, metal or any other suitable material. In an exemplary embodiment of the present invention, the disposable lighter holder 100 may be a scale model vehicle disposable lighter holder. The two body portions 102, 104 may include, for example, a main body portion 102 having a shaped body of a model car 100 and a subsidiary body portion 104 having a shape of the base or chassis of a model car including stationary or movable wheels 110. The two body portions 102, 104 may be connected together in a manner appropriate to the material from which they are made.

In an exemplary embodiment of the present invention, the body portion 102 of the disposable lighter holder 100 has an aperture 112 in the rear portion as shown in FIG. 5. For example, the rear portion of the disposable lighter holder 100 may correspond to the area of a full-size sedan occupied by the boot. The aperture 112, for example, of the disposable lighter holder 100 may have a cross-section which is sized and dimensioned to receive the body of a conventional lighter 14 in a reasonably tight fit. The cross-section of the aperture 112, however, will be of a size to allow the body of a conventional lighter 14 to be pushed fully into the disposable lighter holder 100.

In an exemplary embodiment of the present invention, the body portion 102 also includes two lugs 114, 116 as shown in FIGS. 5 and 6. The lugs 114, 116 depend from the body portion 102. As shown in FIG. 6, the body portion 102 includes lugs 114, 116 orientated at an angle to the longitudinal axis of the body portion 102 to facilitate the gripping of the base of a disposable lighter 14 there between. A first shallow, recess 118 into which the base of a disposable lighter 14 is adapted to be seated is located between lugs 114, 116 as shown in FIG. 6. Further, the base of the disposable lighter 128 rests against an abutment 120 at the forward end of the first recess 118 when being held by the disposable lighter holder 100.

In FIG. 6, a second shallow, recess 122 is shown in the interior of a subsidiary body portion 104. The second recess 122 has a concave surface and tapering sides 124, 126. The body portions 102, 104 are connected together to produce a disposable lighter holder 100. When the conventional lighter 14 is placed into the aperture 112 of the disposable lighter holder 100, the aperture 112, lugs 114, 116, first recess 118, abutment 120, and second recess 122 act to frictionally engage the body of a conventional lighter 128. FIG. 7 shows how a scale model vehicle lighter holder 100 according to an exemplary embodiment of the present invention appears when a conventional lighter 128 has been located therein.

This patent application incorporates herein by reference, in its entirety, Australian provisional patent application No. PP5088 filed on Aug. 6, 1998 and titled "DISPOSABLE SCALE MODEL VEHICLE CIGARETTE LIGHTER" and Australian provisional patent application No. PQ0747 filed on Jun. 3, 1999 and titled "SCALE MODEL VEHICLE WITH CIGARETTE LIGHTER".

The embodiments described above are illustrative examples of the present invention and it should not be construed that the present invention is limited to these particular embodiments. Various changes and modifications may be effected by one skilled in the art without departing from the spirit or scope of the invention as defined in the appended claims.

What is claimed is:

1. A lighter holder comprising:

a first body member having an aperture;

a plurality of lugs connected to the first body member;

a first recess located between the plurality of lugs; and an abutment located at an end of the first recess;

wherein the aperture, the first recess and the plurality of lugs frictionally engage a lighter inserted through the aperture of the first body member.

2. The lighter holder according to claim 1, further comprising:

a second body member being connected to the first body member;

a second recess formed in the second body member, the second recess having a concave surface and a plurality of tapering sides;

wherein the concave surface and the plurality of tapering sides of the second recess engage the lighter inserted through the aperture of the first body member.

3. The lighter holder according to claim 1, wherein the first body member includes a front end and a rear end, the aperture being located at the rear end and the abutment being located at the front end of the first body member.

4. The lighter holder according to claim 1, wherein the plurality of lugs are oriented at an angle to a longitudinal axis of the first body member for engaging the lighter.

5. The lighter holder according to claim 1, wherein the plurality of lugs are two.

6. The lighter holder according to claim 1, wherein the first body member is at least a portion of a scale model vehicle.

7. The lighter holder according to claim 1, wherein the first body member is at least a portion of a scale model car.

8. The lighter holder according to claim 1, wherein the first body member is at least a portion of a scale model NASCAR.

9. The lighter holder according to claim 2, wherein the second body member is at least a portion of a scale model vehicle.

10. The lighter holder according to claim 2, wherein the second body member is at least a portion of a scale model car.

11. The lighter holder according to claim 2, wherein the second body member is at least a portion of a scale model race car.

12. A disposable lighter holder comprising:

a first body member having an aperture;

a plurality of lugs connected to the first body member;

a first recess located between the plurality of lugs;

an abutment located at an end of the first recess;

a second body member being opposite and connected to the first body member;

a second recess formed in the second body member, the second recess having a concave surface and a plurality of tapering sides;

wherein the aperture, the first recess, the plurality of lugs, the concave surface and the plurality of tapering sides of the second recess frictionally engage a lighter inserted through the aperture of the first body member.

13. The lighter holder according to claim 12, wherein the first body member includes a front end and a rear end, the aperture being located at the rear end and the abutment being located at the front end of the first body member.

14. The lighter holder according to claim 12, wherein the plurality of lugs are one-way lugs are oriented at an angle to a longitudinal axis of the first body member for engaging the lighter and preventing the lighter from being removed.

15. The lighter holder according to claim 1, wherein at least one of the first body member and the second body member forms a scale model race car.

* * * * *